US008753800B2

(12) United States Patent
Uohashi et al.

(10) Patent No.: US 8,753,800 B2
(45) Date of Patent: Jun. 17, 2014

(54) PROCESS FOR PRODUCING EJECTION ORIFICE FORMING MEMBER AND LIQUID EJECTION HEAD

(71) Applicant: Canon Kabushiki Kaisha, Tokyo (JP)

(72) Inventors: Kunihito Uohashi, Yokohama (JP); Shuji Koyama, Kawasaki (JP); Kazuhiro Asai, Kawasaki (JP); Keiji Matsumoto, Kawasaki (JP); Tetsuro Honda, Oita (JP); Masaki Ohsumi, Yokosuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/903,172

(22) Filed: May 28, 2013

(65) Prior Publication Data

US 2013/0330673 A1 Dec. 12, 2013

(30) Foreign Application Priority Data

Jun. 11, 2012 (JP) ..... 2012-131696

(51) Int. Cl.
*B41J 2/16* (2006.01)

(52) U.S. Cl.
USPC ..... 430/320

(58) Field of Classification Search
None
See application file for complete search history.

(56) References Cited

U.S. PATENT DOCUMENTS

| | | | | |
|---|---|---|---|---|
| 7,520,591 | B2 | 4/2009 | Suzuki et al. | |
| 2008/0122895 | A1 * | 5/2008 | Hart et al. | 347/47 |
| 2011/0157279 | A1 * | 6/2011 | Nielsen et al. | 347/47 |
| 2012/0115089 | A1 * | 5/2012 | Ishizuka et al. | 430/320 |

FOREIGN PATENT DOCUMENTS

JP 2006-088414 A 4/2006

* cited by examiner

*Primary Examiner* — John A. McPherson
(74) *Attorney, Agent, or Firm* — Fitzpatrick, Cella, Harper & Scinto

(57) ABSTRACT

A process for producing an ejection orifice forming member including the steps of forming a laminate including a first negative photosensitive resin layer that contains a first photoacid generator, and a second negative photosensitive resin layer that is formed on the first negative photosensitive resin layer and contains a second photoacid generator; forming a first latent image and a second latent image on the first negative photosensitive resin layer and the second negative photosensitive resin layer, respectively, by collectively subjecting the first negative photosensitive resin layer and the second negative photosensitive resin layer to exposure; performing a heat treatment after the exposure; and forming the ejection orifice by a development treatment. The first photoacid generator in the first latent image has an acid diffusion length greater than the acid diffusion length of the second photoacid generator in the second latent image.

10 Claims, 4 Drawing Sheets

PROCESS FOR PRODUCING EJECTION ORIFICE FORMING MEMBER AND LIQUID EJECTION HEAD

BACKGROUND OF THE INVENTION

1. Field of the Invention

The present invention relates to a process for producing an ejection orifice forming member and a liquid ejection head.

2. Description of the Related Art

An ejection orifice forming member of an ink jet recording head, which is an important member that determines an ink ejection performance, is required to have a highly precise ejection orifice shape and a flow path shape that optimizes the ejection efficiency and refill efficiency.

In this regard, there are known an ejection orifice having a counterbore shape at a peripheral portion of an opening on an ink ejection side, and an ejection orifice including a portion with a smaller inner diameter on the inside of the ejection orifice. For example, Japanese Patent Application Laid-Open No. 2006-088414 discloses, as a process for producing an ejection orifice structure including a portion with a smaller inner diameter on the inside of the ejection orifice, a production method in which an ejection orifice forming member having an ejection orifice formed therein and a nozzle film are bonded together and the ejection orifice is processed on the nozzle film by a laser.

SUMMARY OF THE INVENTION

According to the present invention, there is provided a process for producing an ejection orifice forming member including an ejection orifice having a counterbore shape, the process including the steps of (1) forming a laminate including a first negative photosensitive resin layer that contains a first photoacid generator; and a second negative photosensitive resin layer that is formed on the first negative photosensitive resin layer and contains a second photoacid generator; (2) forming a first latent image and a second latent image on the first negative photosensitive resin layer and the second negative photosensitive resin layer, respectively, by collectively subjecting the first negative photosensitive resin layer and the second negative photosensitive resin layer to exposure; (3) performing heat treatment after the exposure; and (4) forming the ejection orifice by a development treatment, in which the first photoacid generator in the first latent image has an acid diffusion length greater than the acid diffusion length of the second photoacid generator in the second latent image.

Further features of the present invention will become apparent from the following description of exemplary embodiments with reference to the attached drawings.

DESCRIPTION OF THE EMBODIMENTS

Figure 1A:
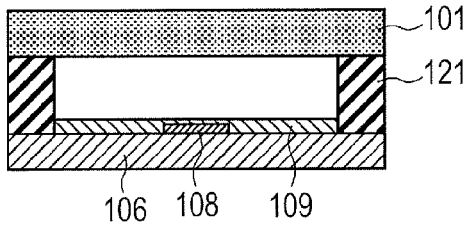
FIGS. 1A, 1B, 1C, 1D and 1E are schematic sectional process views for illustrating a process for producing an ejection orifice forming member according to an embodiment of the present invention.

Preferred embodiments of the present invention will now be described in detail in accordance with the accompanying drawings.

The method disclosed in Japanese Patent Application Laid-Open No. 2006-088414 requires a process in which the layers of the ejection orifice forming member are bonded together after processing the layers and are further subjected to laser processing after bonding, which results in complication of the process.

Accordingly, it is an object of the present invention to provide a method for easily producing an ejection orifice forming member including an ejection orifice having a counterbore shape.

The present invention relates to a process for producing an ejection orifice forming member including an ejection orifice having a counterbore shape. The counterbore shape is preferably formed at a side where a liquid such as ink is ejected.

First, a laminate which includes a first negative photosensitive resin layer that contains a first photoacid generator; and a second negative photosensitive resin layer that is formed on the first negative photosensitive resin layer and contains a second photoacid generator is formed. The first negative photosensitive resin layer can be formed on a flow path wall forming member or a flow path mold material serving as a mold of a liquid flow path, for example.

Next, the first negative photosensitive resin layer and the second negative photosensitive resin layer are collectively subjected to exposure to thereby form a first latent image and a second latent image on the first negative photosensitive resin layer and the second negative photosensitive resin layer, respectively.

Next, a heat treatment is performed after the exposure.

Next, the ejection orifice is formed by a development treatment. A latent image portion of the first latent image and the second latent image, which is an unexposed portion, is removed, and this removed portion forms the ejection orifice.

According to this embodiment, the first photoacid generator in the first latent image has an acid diffusion length greater than the acid diffusion length of the second photoacid generator in the second latent image. In other words, in the heat treatment, an acid derived from the photoacid generator contained in the exposed portion of the negative photosensitive resin layer is diffused into the latent image portion of the unexposed portion, and the unexposed portion in which the acid is diffused is hardened to thereby form a part of an ejection orifice forming member. In this embodiment, the diffusion length for which the acid derived from the first photoacid generator generated in the exposed portion of the first negative photosensitive resin layer is diffused in the first latent image (hereinafter referred to also as "first diffusion length") is set to be greater than the diffusion length for which the acid derived from the second photoacid generator generated in the exposed portion of the second negative photosensitive resin layer is diffused in the second latent image (hereinafter referred to also as "second diffusion length").

The first diffusion length can be set to be greater than the second diffusion length by selecting a type of a solvent, which is contained in the negative resin layer, especially, the boiling point of the solvent, for example. Specifically, the boiling point of the solvent contained in a first resin layer is set to be higher than the boiling point of the solvent contained in a second resin layer, thereby easily increasing the residual amount of the solvent contained in the first resin layer during and after the exposure. In general, the acid diffusion length increases with increasing residual solvent amount, which makes it possible to increase the first diffusion length. For example, in the case of performing exposure and a post-baking process using onium salt as an initiator, when the residual solvent amount is increased by 10-fold from 0.1% to 1.0%, the acid diffusion length is increased by about 4-fold. Further, for example, the diffusion length can be adjusted by appropriately selecting the type of the photoacid generator contained in the negative resin layer. For example, the selection of the photoacid generator such that the size of the acid generated from the first photoacid generator is smaller than the size of the acid generated from the second photoacid generator enables setting of the first diffusion length to be greater than the second diffusion length. For example, the diffusion length increases for a small acid such as trifluoromethanesulfonic acid, while the diffusion length decreases for a large acid such as perfluorooctanesulfonic acid.

Hereinafter, embodiments of the present invention will be described. Note that an ink jet recording head is herein described by way of example, as an application example of the present invention. However, the application range of the present invention is not limited to this, but the present invention can also be applied to a liquid ejection head for fabricating a biochip or electronic circuit printing. In addition to the ink jet recording head, a head for producing a color filter or the like, for example, can also be used as the liquid ejection head.

Figure 2:
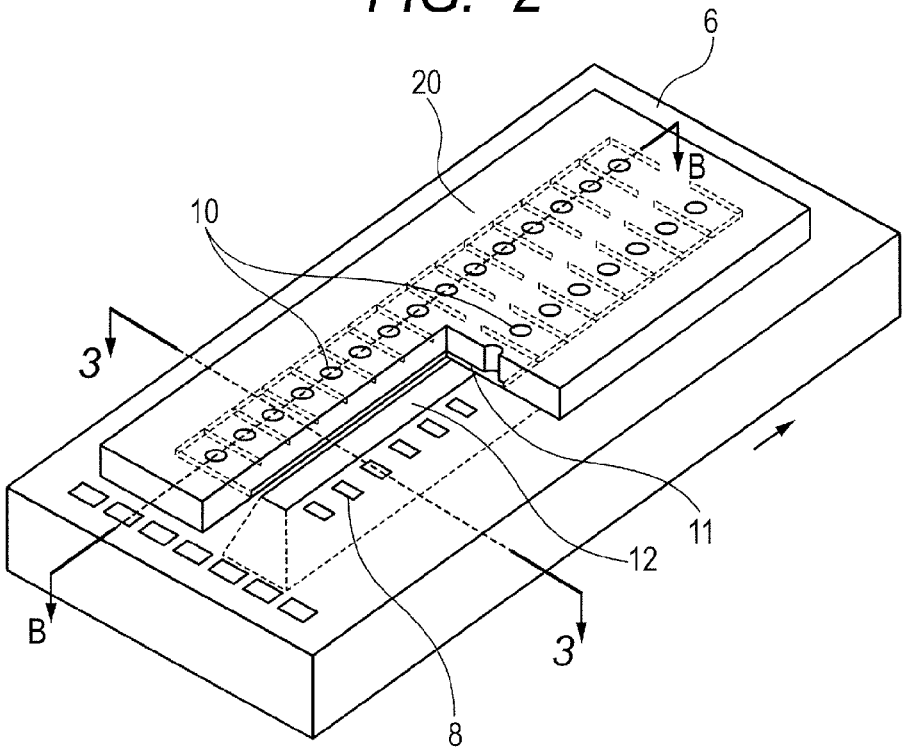
FIG. 2 is a schematic perspective view illustrating an example of an ink jet recording head produced according to the embodiment of the present invention.
Figure 3:
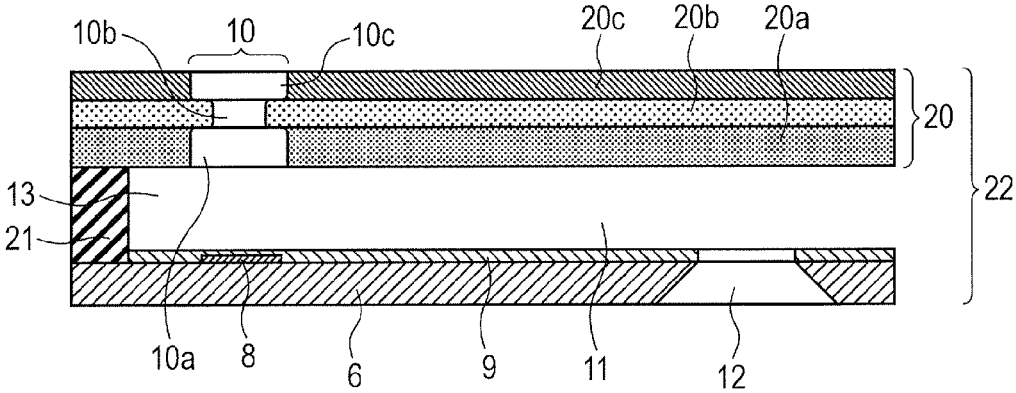
FIG. 3 is a schematic sectional view illustrating an example of the ink jet recording head produced according to the embodiment of the present invention.

FIG. 2 is a schematic perspective view illustrating a configuration example of an ink jet recording head obtained by the production method according to an embodiment of the present invention. FIG. 3 is a schematic sectional view illustrating a cross-section taken along the dashed line 3-3 of FIG. 2.

As illustrated in FIG. 3, an ink jet recording head 22 includes a substrate (for example, silicon substrate) 6, a flow path wall forming member 21 formed on the substrate 6, and an ejection orifice forming member 20 formed on the flow path wall forming member 21.

The ejection orifice forming member 20 includes an ejection orifice 10. The ejection orifice 10 has a portion with a smaller inner diameter on the inside thereof. Referring to FIG. 3, the ejection orifice forming member 20 includes a first layer (referred to also as "lower layer") 20*a*, a second layer (referred to also as "intermediate layer") 20*b*, and a third layer (referred to also as "upper layer") 20*c*. The lower layer 20*a*, the intermediate layer 20*b*, and the upper layer 20*c* are provided with a first opening (referred to also as "lower layer opening") 10*a*, a second opening (referred to also as "intermediate layer opening") 10*b*, and a third opening (referred to also as "upper layer opening") 10*c*, respectively. The lower layer opening 10*a*, the intermediate layer opening 10*b*, and the upper layer opening 10*c* communicate with each other to thereby constitute the ejection orifice 10. The intermediate layer opening 10*b* has an opening diameter smaller than that of each of the lower layer opening 10*a* and the upper layer opening 10*c*, and the ejection orifice has a constricted shape on the inside thereof. The lower layer opening 10*a*, the intermediate layer opening 10*b*, and the upper layer opening 10*c* are coaxially formed.

The flow path wall forming member 21 forms a side wall portion of an ink flow path (liquid flow path) 11 for supplying ink to the ejection orifice.

The substrate 6 is provided with an ejection energy generating element 8 which is formed on a first surface (referred to also as "front surface"). A protective film 9 is formed on the substrate front surface. An ink supply port (liquid supply port) 12 is formed on the substrate 6 as a through-hole for supplying ink to the ink flow path 11.

(First Embodiment)

A first embodiment of the present invention will be described below.

FIGS. 6A to 6E are sectional process views of a cross-section taken along the dashed line 3-3 of FIG. 2, and are schematic sectional process views for illustrating the process for producing an ejection orifice forming member according to this embodiment. The process for producing an ejection orifice forming member having a counterbore shape on the opening side of the ejection orifice will be described below with reference to FIGS. 6A to 6D.

Figure 6A:
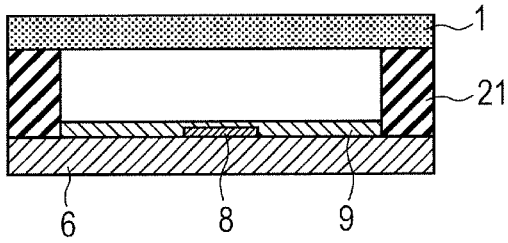
FIGS. 6A, 6B, 6C and 6D are schematic sectional process views for illustrating the process for producing an ejection orifice forming member according to the embodiment of the present invention.

First, as illustrated in FIG. 6A, a first resin layer (corresponding to the above-mentioned first negative photosensitive resin layer) 1 is formed on a flow path wall forming member 21.

Note that in FIG. 6A, an ejection energy generating element 8 is formed on the first surface (front surface) side of a substrate 6 such as a silicon substrate. Reference numeral 9 denotes a protective film. A flow path wall forming member 21 which forms a side wall of an ink flow path (liquid flow path) is formed on the substrate 6.

The first resin layer 1 is not particularly limited, but can be formed using a dry film, for example. A dry film resist made of a chemically-amplified resist is preferably used.

A solvent contained in the first resin layer (hereinafter referred to also as "first solvent") is preferably a solvent having a boiling point of 170° C. or higher. Examples of the solvent include γ-butyrolactone.

The boiling point of the first solvent is in the range of 170 to 310° C., for example, and is preferably in the range of 200 to 220° C.

Figure 6B:
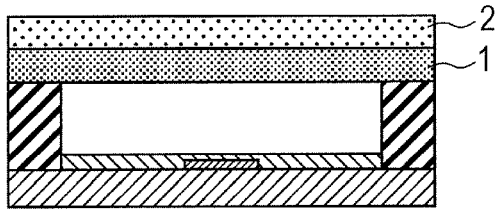

Next, as illustrated in FIG. 6B, a second resin layer (corresponding to the above-mentioned second negative photosensitive resin layer) 2 is formed on the first resin layer 1.

The second resin layer 2 is not particularly limited, but can be formed using a dry film, for example. A dry film resist made of a chemically-amplified resist is preferably used.

A solvent contained in the second resin layer 2 (hereinafter referred to also as "second solvent") is preferably a solvent having a boiling point lower than that of the first solvent included in the first resin layer.

The boiling point of the second solvent is in the range of 100 to 170° C., for example, and is preferably in the range of 130 to 150° C.

The difference between the boiling point of the first solvent and the boiling point of the second solvent is in the range of 20 to 170° C., for example, and is preferably in the range of 50 to 70° C.

Examples of the second solvent include PGMEA and xylene.

Further, the photoacid generators contained in the first resin layer 1 and the second resin layer 2 are not particularly limited, as long as the photoacid generator with which a desired pattern can be obtained are used. The photoacid generators of the same type are preferably used.

Figure 6C:
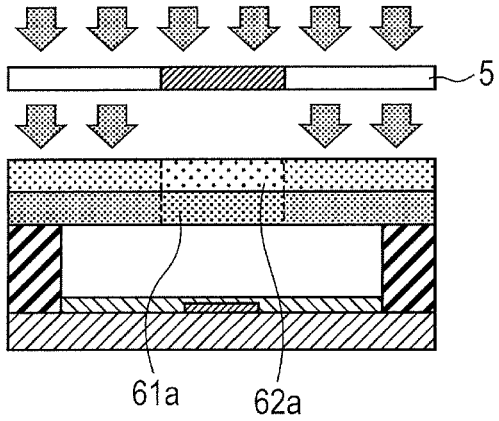

Next, as illustrated in FIG. 6C, a first latent image 61*a* and a second latent image 62*a* are formed by subjecting the first resin layer 1 and the second resin layer 2 to exposure. After the exposure, a heat treatment (hereinafter referred to also as "PEB") is performed.

The exposure amount and conditions for the heat treatment are not limited, as long as a desired pattern is formed. The temperature of the heat treatment is in range of 50 to 150° C., for example, and is preferably in the range of 60 to 90° C.

The exposure is performed using a mask 5 having a light-blocking pattern corresponding to the ejection orifice.

In this case, a solvent having a boiling point higher than the boiling point of the second solvent is used as the first solvent, thereby making it possible to set the remaining amount of the solvent contained in an exposed portion of the first resin layer before heat treatment to be greater than the remaining amount of the solvent contained in an exposed portion of the second resin layer. Note that the term "remaining solvent amount" refers to an amount (wt %) of solvent per unit volume within the resin film until immediately before the PEB process after the exposure.

Figure 6D:
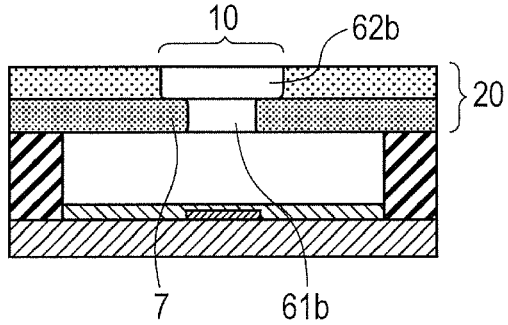

Next, as illustrated in FIG. 6D, an ejection orifice forming member 20 is formed by performing a development treatment.

The first latent image 61*a* and the second latent image 62*a* are removed by the development treatment, and the first latent image 61*a* and the second latent image 62*a* become a first removal-formed space 61*b* and a second removal-formed space 62*b*, respectively. The first and second removal-formed spaces constitute the ejection orifice 10. In this case, the remaining solvent amount of the first resin layer is larger than the remaining solvent amount of the second resin layer. Accordingly, the acid diffusion length in the first latent image 61*a* is larger than the acid diffusion length in the second latent image 62*a*. Therefore, the diameter of the first removal-formed space 61*b* is smaller than the diameter of the second removal-formed space 62*b*, and the obtained ejection orifice has a counterbore shape on the opening side where ink is ejected. In this embodiment, the ejection orifice having such a counterbore shape can be easily formed by one exposure, one PEB treatment, and one development treatment.

The length of an overhang 7 (a difference between the opening radius of the second removal-formed space 62*b* and the opening radius of the first removal-formed space) is, for example, 2 to 5 μm. The length of the overhang 7 can be appropriately adjusted depending on the type of solvents, heat conditions, and the type of resins.

After that, the substrate having nozzles formed thereon was cut and separated by a dicing saw or the like and formed into chips. After an electrical junction for driving an ejection energy generating element 3 is provided, a chip tank member for supplying ink is connected to thereby complete the ink jet recording head.

As illustrated in this embodiment, the remaining solvent amount is controlled using the difference in boiling point of the solvents to be used. This facilitates making a difference in the acid diffusion length within each resist layer, and makes it possible to collectively form patterns having different opening diameters.

In the ejection orifice forming member formed according to this embodiment, the ejection orifice has a counterbore shape, which prevents occurrence of damage due to a contact with a wiping mechanism.

The liquid ejection head obtained according to this embodiment can be mounted on an image forming apparatus.

(Second Embodiment)

Next, a second embodiment of the present invention will be described.

FIGS. 1A to 1E are sectional process views of a cross-section taken along the dashed line 3-3 of FIG. 2 and are schematic cross-sectional process views for illustrating a process for producing an ejection orifice forming member according to this embodiment.

First, as illustrated in FIG. 1A, a negative photosensitive resin layer (hereinafter referred to also as "photosensitive resin lower layer" or "third negative photosensitive resin layer") 101 is formed on a flow path wall forming member 121.

Note that in FIG. 1A, an ejection energy generating element 108 is formed on a first surface (front surface) side of a substrate 106 such as a silicon substrate. Reference numeral 109 denotes a protective film. The flow path wall forming member 121 which forms a side wall of an ink flow path (liquid flow path) is formed on the substrate 106.

Note that the laminate according to this embodiment has a structure in which the first negative photosensitive resin layer is disposed on the third negative photosensitive resin layer and the second negative photosensitive resin layer is disposed on the first negative photosensitive resin layer. In other words, as compared with the first embodiment, the laminate according to this embodiment has a structure in which the third negative photosensitive resin layer containing a third photo-acid generator is further formed on a surface of the first negative photosensitive resin layer opposite to the second negative photosensitive resin layer.

The photosensitive resin lower layer 101 is not particularly limited, but can be formed by using a dry film, for example. A dry film resist made of a chemically-amplified resist is preferably used.

A solvent contained in the photosensitive resin lower layer 101 (hereinafter referred to also as "lower-layer-contained solvent") is preferably a solvent having a boiling point in the range of 100° C. to 170° C. Examples of the lower-layer-contained solvent include PGMEA (propylene glycol monomethyl ether acetate) and xylene.

Figure 1B:
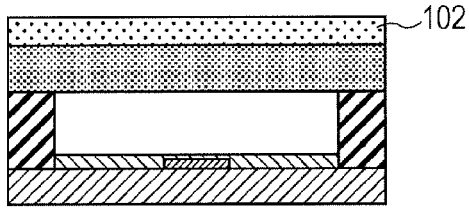

Next, as illustrated in FIG. 1B, a negative photosensitive resin layer (which is hereinafter referred to also as "photosensitive resin intermediate layer" and corresponds to the above-mentioned first negative photosensitive resin layer) 102 is formed on the photosensitive resin lower layer 101.

The photosensitive resin intermediate layer 102 is not particularly limited. For example, a dry film can be used. A dry film resist made of a chemically-amplified resist is preferably used.

A solvent contained in the photosensitive resin intermediate layer 102 (hereinafter referred to also as "intermediate-layer-contained solvent") is preferably a solvent having a boiling point higher than that of the lower-layer-contained solvent.

The intermediate-layer-contained solvent is preferably a solvent having a boiling point in the range of 200 to 220° C. Examples of the intermediate-layer-contained solvent include γ-butyrolactone.

Figure 1C:
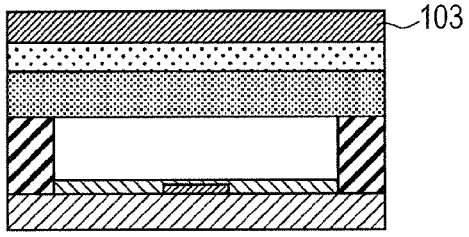

Next, as illustrated in FIG. 1C, a negative photosensitive resin layer (which is hereinafter referred to also as "photosensitive resin upper layer" and corresponds to the above-mentioned second negative photosensitive resin layer) 103 is formed on the photosensitive resin intermediate layer 102.

The photosensitive resin upper layer 103 is not particularly limited, but a dry film can be used, for example. A dry film resist made of a chemically-amplified resist is preferably used.

A solvent contained in the photosensitive resin upper layer 103 (hereinafter referred to also as "upper-layer-contained solvent") is preferably a solvent having a boiling point lower than that of the intermediate-layer-contained solvent.

The upper-layer-contained solvent is preferably identical with the lower-layer-contained solvent (referred to also as "third solvent"). The negative photosensitive resin upper layer 103 is preferably made of the same material as that of the negative photosensitive resin lower layer 101.

The photoacid generator contained in each resin layer is not particularly limited, but may be a photoacid generator with which a desired pattern is obtained.

Figure 1D:
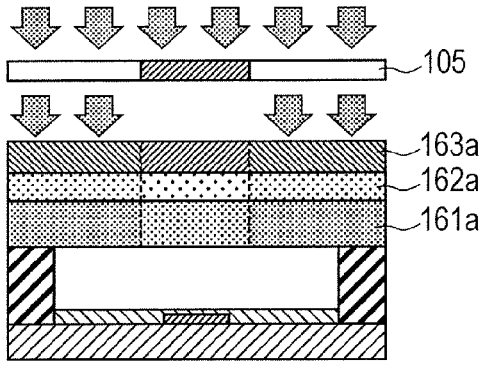

Next, as illustrated in FIG. 1D, an exposure is collectively performed to thereby form a lower layer latent image 161*a* including an unexposed portion, an intermediate layer latent image 162*a*, and an upper layer latent image 163*a*. Subsequently, a heat treatment (PEB) is performed.

The exposure amount and PEB conditions are not particularly limited, as long as a desired pattern can be formed.

The exposure allows the lower layer latent image 161*a* to be formed on the negative photosensitive resin lower layer 101, the intermediate layer latent image 162*a* to be formed on the negative photosensitive resin intermediate layer 102, and the upper layer latent image 163*a* to be formed on the negative photosensitive resin upper layer 103.

Figure 1E:
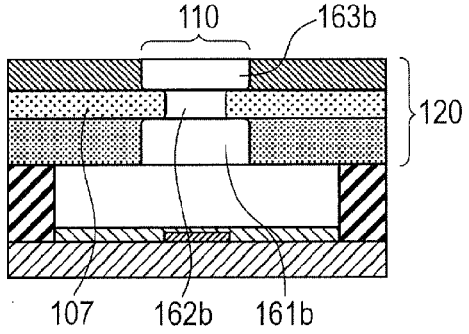

Next, as illustrated in FIG. 1E, an ejection orifice forming member 120 is formed by performing a development treatment.

The development treatment allows the lower layer latent image (referred to also as "third latent image") 161*a*, the intermediate layer latent image 162*a*, and the upper layer latent image 163*a* to be removed. The lower layer latent image 161*a*, the intermediate layer latent image 162*a*, and the upper layer latent image 163*a* become a lower layer removal-formed space 161*b*, an intermediate layer removal-formed space 162*b*, and an upper layer removal-formed space 163*b*, respectively. The lower layer removal-formed space 161*b*, the intermediate layer removal-formed space 162*b*, and the upper layer removal-formed space 163*b* constitute an ejection orifice 110. In this case, the remaining solvent amount of the lower layer latent image 161*a* is smaller than the remaining solvent amount of the intermediate layer latent image 162*a*. Accordingly, the diffusion length of the acid (derived from the third photoacid generator) in the lower layer latent image 161*a* is smaller than the acid diffusion length in the intermediate layer latent image 162*a*. Further, the remaining solvent amount of the upper layer latent image 163*a* is smaller than the remaining solvent amount of the intermediate layer latent image 162*a*. Accordingly, the acid diffusion length in the upper layer latent image 163*a* is smaller than the acid diffusion length in the intermediate layer latent image 162*a*. Therefore, the diameter of the lower layer removal-formed space 161*b* is greater than the diameter of the intermediate layer removal-formed space 162*b*, and the diameter of the upper layer removal-formed space 163*b* is greater than the diameter of the intermediate layer removal-formed space 162*b*. The obtained ejection orifice has a counterbore shape on the opening side where ink is ejected, and has a constricted shape on the inside thereof. In this embodiment, the ejection orifice having such a constricted shape can be formed by one exposure, one PEB treatment, and one development treatment.

The length of the overhang 107 (a difference between the opening radius of the upper layer removal-formed space 163*b* and the opening radius of the intermediate layer removal-formed space 162*b*) is, for example, 2 to 5 μm.

After that, the substrate having nozzles formed thereon was cut and separated by a dicing saw or the like and formed into chips. After an electrical junction for driving the ejection energy generating element 103 is provided, a chip tank member for supplying ink is connected to thereby complete the ink jet recording head.

In the ejection orifice forming member formed according to this embodiment, the ejection orifice has a counterbore shape, which prevents occurrence of damage due to a contact with a wiping mechanism. The ejection orifice forming member can reduce a resistance during ejection of ink even when the ejection orifice is formed with a small opening diameter, which provides excellent ejection efficiency.

EXAMPLE 1

Referring to FIGS. 1A to 1E, a specific process for producing an ejection orifice forming member including an intermediate layer having an opening with a small inner diameter will be described.

In this example, a solvent having a high boiling point was used as the solvent contained in the resist intermediate layer 102, and the remaining solvent amount in the resist film was adjusted. Assume that every resist contains none of a thermal acid generator and a thermal curing catalyst.

First, as illustrated in FIG. 1A, the resist lower layer 101 was transferred onto the flow path wall forming member 121. The resist lower layer 101 is a dry film resist which is made of an epoxy resin and has a film thickness of 6 μm. As the solvent contained in the film, PGMEA was selected. In this case, the amount of the solvent contained in the resist lower layer 101 is 0.1 mass %.

Next, as illustrated in FIG. 1B, the resist intermediate layer 102 was transferred onto the resist lower layer 101. The resist intermediate layer 102 is a dry film resist which is made of an epoxy resin and has a film thickness of 2 μm. As the solvent contained in the film, γ-butyrolactone was selected. In this case, the amount of the solvent contained in the resist intermediate layer 102 is 1.2 mass %.

Next, as illustrated in FIG. 1C, the resist upper layer 103 was transferred onto the resist intermediate layer 102. The resist upper layer 103 is a dry film resist which is made of an epoxy resin and has a film thickness of 2 μm. As the solvent contained in the film, PGMEA was selected. In this case, the amount of the solvent contained in the resist upper layer 103 is 0.1 mass %.

For all the photoacid generators contained in the resists 101 to 103, triarylsulfonium salt was selected.

After formation of a laminate formed of the resists 101 to 103, exposure was collectively performed as illustrated in FIG. 1D. Subsequently, PEB was performed.

The exposure was performed with an exposure amount of 6000 [J/m$^2$], and the PEB was performed under the condition of 105° C. for 10 minutes.

Further, the remaining solvent amount of each of the resists 101 to 103 was measured by the following method, and it was confirmed that the remaining solvent amount was controllable. As for the measurement method, a resist having a known solvent amount and weight was transferred onto a flow path wall forming member having a known weight. After the transfer of the resist, the resist was subjected to exposure with an exposure amount of 6000 [J/m$^2$] and the weight after the exposure of the formed product is measured. The weight after the exposure of the resist is calculated by subtracting the weight of the flow path wall forming member from the weight of the formed product. Since it is considered that a change between the initial weight of the resist and the weight after the exposure of the resist is caused due to vaporization of the solvent during the process, the solvent amount after the exposure, that is, the remaining solvent amount can be calculated.

In this manner, the remaining solvent amount for each of the resists 101 to 103 was calculated. As a result of measuring the remaining solvent amount, the remaining solvent amount of each of the resist lower layer 101 and the resist upper layer 103 was in the range of 0.1 to 0.3 wt %. On the other hand, the remaining solvent amount of the resist intermediate layer 102 was in the range of 1.4 to 1.8 wt %. It was confirmed by this measurement that the remaining solvent amount of the resist intermediate layer 102 after the exposure could be controlled so as to be larger than the remaining solvent amount of each of the resist lower layer 101 and the resist upper layer 103 after the exposure.

Note that a repellent film may be formed on the upper surface of the resist upper layer 103 prior to the exposure step. However, the repellent film is formed as needed, and is not necessarily formed.

Next, as illustrated in FIG. 1E, the laminate of the resists 101 to 103 is developed to thereby obtain an ejection orifice forming member including the intermediate layer having an opening with a small inner diameter.

It was confirmed that the overhang 107 of 2 μm was formed on the ejection orifice 110 which had a radius of 10 μm and was included in the ejection orifice forming member 120 formed as described above.

After that, the substrate was cut and separated by a dicing saw or the like and formed into chips, and an electrical junction for driving an ejection energy generating element 108 was performed. After that, a chip tank member for supplying ink was connected to thereby complete the ink jet recording head.

EXAMPLE 2

Figure 4:
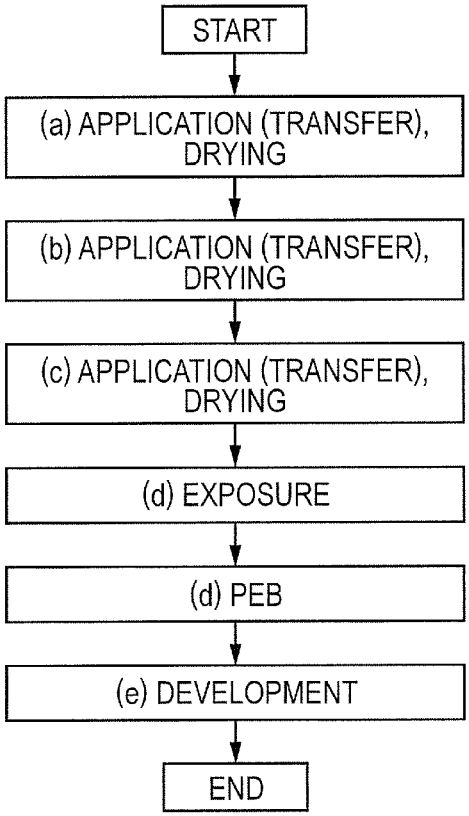
FIG. 4 is a process flow chart illustrating the process for producing an ejection orifice forming member according to the embodiment of the present invention.

In Example 1, the remaining solvent amount until immediately before the PEB after the exposure is controlled using a solvent having a high boiling point, thereby making a difference in the acid diffusion length. Meanwhile, Example 2 illustrates an example of making a difference in the type of photoacid generators of each resist, in addition to the control for the remaining solvent amount. Note that the process flow is identical with that of Example 1 (FIG. 4 illustrates an outline of the process), so only the photoacid generator of each resist will be herein described.

In Example 1, triarylsulfonium salt was selected as the photoacid generators of the resists 101 to 103. Meanwhile, in this example, a generator having a sensitivity higher than that of the photoacid generators contained in the resist lower layer 101 and the resist upper layer 103 is selected as the photoacid generator of the resist intermediate layer 102. The term "generator having a high sensitivity" refers to a photoacid generator with which a large amount of acid is generated at the same exposure amount. In this example, photoacid generators made of triarylsulfonium salt were used as the photoacid generators of the resist lower layer 101 and the resist upper layer 103, and a photoacid generator made of onium salt was used as the photoacid generator of the resist intermediate layer 102. Note that the conditions other than the type of the photoacid generator were the same as those of Example 1.

Figure 5:
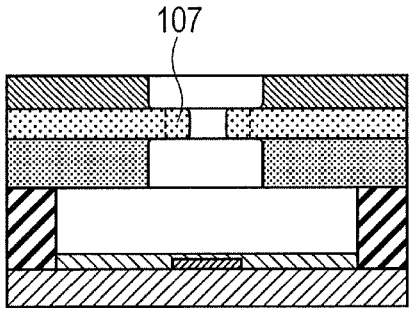
FIG. 5 is a schematic sectional view for illustrating the process for producing an ejection orifice forming member according to the embodiment of the present invention.

The processes shown in FIGS. 1A to 1D are carried out using the resist intermediate layer 102 obtained by adding the photoacid generator having a high sensitivity. After that, as illustrated in FIG. 5, a laminate of the resists 101 to 103 is developed to thereby form an ejection orifice forming member. At this time, it was confirmed that an overhang 107 of 5 μm was formed on an ejection orifice 10 having a radius of 10 μm. Note that the dashed lines in FIG. 5 represent the length of the overhang 7 of Example 1.

As in this example, the amount of acid generated when an exposure is performed with the same exposure amount can be controlled by making a difference in the photoacid generators. This enables controlling the length of the overhang 7. In the case of using the photoacid generator having a high sensitivity as in this example, the amount of acid generated in the resist intermediate layer 102 increases, so that the length of the overhang 107 can be made longer than that of Example 1. The length of the overhang 107 can be further adjusted by selecting the sensitivity of the photoacid generator of the resist intermediate layer 102.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-131696, filed Jun. 11, 2012, which is hereby incorporated by reference herein in its entirety.

What is claimed is:

1. A process for producing an ejection orifice forming member including an ejection orifice having a counterbore shape, the process comprising the steps of:

(1) forming a laminate comprising a first negative photosensitive resin layer that contains a first photoacid generator, and a second negative photosensitive resin layer that is formed on the first negative photosensitive resin layer and contains a second photoacid generator;

(2) forming a first latent image and a second latent image on the first negative photosensitive resin layer and the second negative photosensitive resin layer, respectively, by collectively subjecting the first negative photosensitive resin layer and the second negative photosensitive resin layer to exposure;

(3) performing a heat treatment after the exposure; and (4) forming the ejection orifice by a development treatment, wherein the first photoacid generator in the first latent image has an acid diffusion length greater than the acid diffusion length of the second photoacid generator in the second latent image.

2. The process for producing an ejection orifice forming member according to claim 1, wherein prior to the heat treatment in the step (3) after the exposure in the step (2), a remaining solvent amount of the first negative photosensitive resin layer is larger than a remaining solvent amount of the second negative photosensitive resin layer.

3. The process for producing an ejection orifice forming member according to claim 2, wherein a boiling point of a first solvent contained in the first negative photosensitive resin layer is higher than a boiling point of a second solvent contained in the second negative photosensitive resin layer.

4. The process for producing an ejection orifice forming member according to claim 1, wherein the first photoacid generator has a sensitivity higher than that of the second photoacid generator.

5. The process for producing an ejection orifice forming member according to claim 1, wherein the first negative photosensitive resin layer and the second negative photosensitive resin layer contain none of a thermal acid generator and a thermal curing catalyst.

6. The process for producing an ejection orifice forming member according to claim 1, wherein:

in the step (1), the laminate further includes a third negative photosensitive resin layer containing a third photoacid generator, the third negative photosensitive resin layer being formed on a surface of the first negative photosensitive resin layer opposite to the second negative photosensitive resin layer, in the step (2), a third latent image is formed on the third negative photosensitive resin layer by collectively subjecting the negative photosensitive resin layers containing the third negative photosensitive resin layer to exposure, and the first photoacid generator in the first latent image has an acid diffusion length greater than the acid diffusion length of the third photoacid generator in the third latent image.

7. The process for producing an ejection orifice forming member according to claim 6, wherein prior to the heat treatment in the step (3) after the exposure in the step (2), a remaining solvent amount of the first negative photosensitive resin layer is larger than a remaining solvent amount of the third negative photosensitive resin layer.

8. The process for producing an ejection orifice forming member according to claim 7, wherein a boiling point of a first solvent contained in the first negative photosensitive resin layer is higher than a boiling point of a third solvent contained in the third negative photosensitive resin layer.

9. The process for producing an ejection orifice forming member according to claim 6, wherein the first photoacid generator has a sensitivity higher than that of the third photoacid generator.

10. The process for producing an ejection orifice forming member according to claim 6, wherein the second negative photosensitive resin layer and the third negative photosensitive resin layer are made of the same material.

* * * * *